United States Patent [19]

White

[11] Patent Number: 4,534,371

[45] Date of Patent: Aug. 13, 1985

[54] SMOKING PRODUCT

[75] Inventor: Jackie L. White, Pfafftown, N.C.

[73] Assignee: R. J. Reynolds Tobacco Company, Winston-Salem, N.C.

[21] Appl. No.: 525,020

[22] Filed: Aug. 22, 1983

[51] Int. Cl.[3] ..... A24B 3/00; A24B 15/18; A24D 1/18

[52] U.S. Cl. ..... 131/359; 131/352; 131/353; 131/354; 131/358; 131/369; 131/370; 131/371

[58] Field of Search ..... 131/369, 370, 371, 354, 131/355, 356, 358, 352, 353, 359

[56] References Cited

U.S. PATENT DOCUMENTS

| | | | |
|---|---|---|---|
| 2,786,471 | 3/1957 | Graybeal | 131/331 |
| 2,955,060 | 10/1960 | North | 131/352 |
| 2,996,065 | 10/1961 | North | 131/352 |
| 3,005,732 | 10/1961 | Specht | 131/352 |
| 3,638,660 | 2/1972 | Davis | 131/359 |
| 3,931,824 | 1/1976 | Miano et al. | 131/359 |
| 4,233,993 | 11/1980 | Miano et al. | 131/359 |
| 4,296,762 | 10/1981 | Eicher et al. | 131/352 |

FOREIGN PATENT DOCUMENTS

| | | | |
|---|---|---|---|
| 1553326 | 9/1979 | United Kingdom | 131/352 |

*Primary Examiner*—V. Millin

*Attorney, Agent, or Firm*—Herbert J. Bluhm

[57] ABSTRACT

A combustible smoking material having a color other than that of conventionally cured tobacco leaves is coated with finely divided vermiculite that has previously been subjected to heat treatment to develop a brown color therein. The vermiculite coating imparts a tobacco-like brown color to the combustible smoking material.

19 Claims, No Drawings

SMOKING PRODUCT

TECHNICAL FIELD

This invention relates to the preparation of smoking products containing a combustible smoking material which is coated with a coloring agent that imparts a tobacco-like color to the material.

BACKGROUND ART

The prior art discloses a large number of combustible non-tobacco materials which have been proposed as substitutes for tobacco in the preparation of smoking products. Most of these materials do not have colors that are typical of tobacco. Consequently, it is usually desirable to add coloring agents to such materials to improve acceptance by smokers who are accustomed to tobacco-like colors associated with smoking products they consume.

Various coloring agents and techniques have been disclosed in the art for imparting tobacco-like colors to tobacco substituents. For example, U.S. Pat. No. 3,638,660 discloses a tobacco substitute having appropriate dyes incorporated therein. U.S. Pat. No. 3,931,824 describes a cellulose-based tobacco substitute colored with agents such as carbon, iron oxide, food dyes, tobacco extracts, organic colorants and inorganic pigments. These agents are not entirely satisfactory because they may give rise to objectionable flavors upon smoking or they may be impractical due to economic considerations. Another technique for coloring tobacco substitutes is described in British Pat. No. 1,553,326 wherein tobacco dust comprising particles of 75 microns or less in diameter is applied to the surface of previously shredded tobacco substitute material to impart a tobacco-like color thereto. While that technique is effecitve, it also tends to defeat the purpose of adopting tobacco substitutes, namely, the elimination of tobacco from smoking products.

The prior art also discloses a number of agents which have been incorporated into smoking products for the purpose of altering the composition of smoke generated during the smoking process. Among the agents disclosed in vermiculite, a clay mineral comprising a hydrated form of iron magnesium aluminum silicate. The water of hydration in vermiculite is rapidly released upon heating at elevated temperatures thereby causing the vermiculite to expand. The expanded form vermiculite is a suitable filtration material for tobacco smoke as described in U.S. Pat. No. No. 2,786,741.

Unexpanded vermiculite has also been disclosed in U.S. Pat. Nos. 2,955,060 and 2,996,065 as a useful additive in smoking tobacco products at levels of 1 to 35 percent by weight using particle sizes in the range of about 200 to 600 microns. Heat released by the burning tobacco causes the vermiculite to expand and the expanded vermiculite acts as a smoke filtration agent located adjacent to the site at which the smoke is generated.

Various clay minerals are disclosed in U.S. Pat. No. 3,005,732 as tobacco additives capable of reducing the quantity of "tars" in the smoke generated by the treated tobacco and providing other benefits. Vermiculite is one of the minerals taught as being a suitable additive. These additives are used in the form of finely divided particles generally less than about 10 microns in size and, preferably, between 0.5 and 2 microns in size. The quantity of additive mixed with the tobacco is equivalent to 1–20 percent by weight of the tobacco.

The preparation of smokable products based on tobacco or cellulose-containing vegetable material is disclosed in U.S. Pat. No. 4,296,762 wherein combustion-modifying substances are incorporated into the products. The combustion-modifying substances disclosed include vermiculite and they are preferably applied to the surface of a paper-like web of tobacco or cellulose-containing material by immersing the web in an aqueous dispersion of the substance. The average diameter of the particles of combustion-modifying substances applied to the web is less than 2 microns and the quantity incorporated into the smokable product is between 0.1 and 10% by weight based on the total weight of the product.

BRIEF SUMMARY OF THE INVENTION

This invention provides an improved method for imparting a tobacco-like color to smokable materials by applying finely divided vermiculite to the surface of the smokable materials or by incorporating the vermiculite into a slurry of smokable materials that is subsequently shaped into desired form. By employing vermiculite as the coloring agent, it is possible to vary the degree of color imparted to the smokable materials by controlling the color developed by the vermiculite during a heat-treating process. Moreover, the vermiculite is capable of effecting desirable changes in the composition of the smoke which passes into the mouth of the smoker. Accordingly, this invention provides a surprising and unexpected versatility that is not anticipated by the prior art.

DETAILED DESCRIPTION OF THE INVENTION

The smoking products of this invention are typically based on carbohydrated such as cellulose and starch or materials consisting largely of cellulose or starch. The carbohydrates or carbohydrate-containing materials are subjected to a variety of treatments in connection with the preparation of smokable material therefrom. These treatments may be minimal and merely involve a change in the physical shape of the carbohydrate-containing material or they may be extensive and involve chemical and/or thermal degradation of the carbohydrate-containing material. The treatments frequently include addition of inorganic salts, binders, flavorants, and other agents designed to produce a material that has satisfactory combustion and smoking properties. Thus, various treatments may lead to a smokable material that is white, gray, black, etc. depending on the starting materials, the treatment(s) applied and the additives introduced.

In one embodiment of the present invention a combustible smokable material is cut, shredded or otherwise comminuted to give the particle size desired for the smoking product in which it is to be used. The surface of the comminuted smoking material is moistened and/or treated with an adhesive agent and is then coated with a quantity of finely divided vermiculite (described below) sufficient to impart a tobacco-like color to the smoking material. The finely divided vermiculite may be applied to the comminuted smoking material by the procedures described in British Pat. No. 1,553,326 the teachings of which are incorporated herein by reference. In those instances where the combustible smoking material is prepared in the form of a continuous web, the finely divided vermiculite may be applied to the surfce of the web in an analogous manner after the web has been moistened and/or treated with an adhesive agent. In either case it is important that the combustible smoking material having the finely divided vermiculite applied to the surface thereof be gently agitated or subjected to other suitable treatment which promotes distribution of the vermiculite across the entire surface of the smoking material.

The vermiculite used in connection with this invention is a clay mineral of complex structure based on a hydrated form of iron magnesium aluminum silicate. When vermiculite is rapidly heated to about 300° C., its water of hydration is driven off thereby causing the vermiculite to expand greatly. The expanded vermiculite typically possesses a grayish-brown color and a low density. It has been found, however, that heating the expanded vermiculite at temperatures in excess of approximately 500° C. and, preferably, between 600° and 700° C. for a period of time causes the vermiculite to change from a grayish-brown color to a golden-brown color that is similar to the colors found in cured tobacco leaves. Subjecting the expanded vermiculite to heat treatment at temperatures of about 600° to 700° C. for 1 to 2 hours is generally sufficient to produce the desired golden-brown color. This heat treatment may conveniently be carried out in a muffle furnace or other suitable heating device which allows the temperature to be controlled within the desired temperature range.

The heat-treated, golden-brown vermiculite is crushed or milled to give finely divided particles suitable for use with the present invention. Commercially available apparatus may be used to produce the finely divided vermiculite and includes apparatus such as the DM-3C SWECO Vibro-Energy Dry Grinding Mill, a ceramic mill manufactured by SWECO Inc. of Los Angeles, California. The crushing or milling treatment is continued until the maximum diameter of the finely divided particles is approximately 50 microns or less and, preferably, 30 microns or less. If desired, the milled particles may be sieved to remove any oversized particles.

Treatment of the combustible smoking material prior to application of finely divided vermiculite to the surface thereof involves moistening the surface and optionally applying suitable adhesive agents thereto. The combustible smoking materials are typically maintained at moisture levels of 8 to 20 percent while they are being processed for use in the manufacture of smoking products. Aqueous media are used to moisten the surface of the smoking material and the quantities of such media required will be determined by their composition and the moisture content of the smoking material being moistened. It is preferred that between 10 to 50 parts by weight of the desired aqueous medium be applied to each 100 parts by weight of the smoking material being moistened. Although greater proportions of the aqueous medium can be employed (e.g., equal parts of aqueous medium and smoking material), it is usually not advantageous to do so because the excess moisture must be subsequently removed from the treated smoking material before it can be used in the manufacture of smoking products. Appropriate humectant agents such as glycerol and propylene glycol are preferably included in the aqueous media and may constitute up to 25 percent by weight of the aqueous media. When adhesive agents are included in the aqueous media, they are preferably derived from carbohydrates such as starch, cellulose and sucrose (e.g, dextrins, corn syrup, carboxymethylcellulose and invert sugar) and constitute up to 50 percent by weight of the aqueous media.

The quantity of finely divided vermiculite required to impart a tobacco-like color to the combustible smoking material will depend on a number of factors including the initial color and surface texture of the combustible smoking material, the particle size and color of the finely divided vermiculite and the quantity of aqueous medium used to moisten the surface of the smoking material. Generally, the quantity of finely divided vermiculite applied to the combustible smoking material should be at least 15 percent by weight and may constitute up to 50 percent by weight based on the dry weight of the smoking material. Preferably, the quantity of vermiculite applied is between 20 and 30 percent by weight based on the dry weight of the smoking material. The dry weight of the smoking material is defined as the residual weight of the material after it has been treated for 15 minutes in an oven that is maintained at 124° C. and excludes the weight of relatively nonvolatile additives such as humectants and casing materials which may have been previously applied to the smoking material. Following application of the finely divided vermiculite to the surface of the combustible smoking material, the moisture content of the treated smoking material is adjusted, if necessary, to a level of approximately 11 to 14 percent and the coated smoking material is used in the manufacture of smoking products such as smoking tobacco and cigarettes by carefully blending the coated smoking material with the tobacco being processed. The resulting blend or mixture may contain up to 50 percent by weight of the coated smoking material.

The following examples will further illustrate the manner in which this invention may be practiced.

EXAMPLE 1

Expanded vermiculite of the type commonly used for horticultural purposes (Terra-Lite vermiculite available from W. R. Grace & Company, Horticultural Products, Cambridge, Massachusetts) is placed in a shallow, metal pan to give a bed depth of approximately 3 cm. The pan containing the vermiculite is then placed in a muffle furnace and heated at 650° C. for 2 hours. The heat-treated vermiculite is then milled in a DM-3C SWECO ceramic ball mill to a particle size diameter of approximately 10 microns. The bulk density of the heat-treated, milled vermiculite is typically about 0.50 gram per cubic centimeter. The resulting finely divided vermiculite is then applied to a combustible smoking material as described in Example 2.

EXAMPLE 2

A combustible smoking material is prepared by subjecting flue cured tobacco stems to pyrolysis in a nitrogen atmosphere. The stems are gradually heated in an oven over a period of 2 to 3 hours to a temperature of 650° C. and maintained at that temperature for 1 hour before allowing the oven and stems to cool gradually to ambient temperatures. The pyrolyzed stems (one part by weight) are placed in two parts by weight water and milled in a Model 504 Morehouse mill available from Morehouse-Cowles, Inc. of Los Angeles, California, until the maximum particle size is less than 100 microns. The resulting aqueous slurry containing 200 g. of pyrolyzed stem material is combined with 18 grams of sodium carboxymethylcellulose, 10 grams of guar gum and additional water to give a thick paste when thoroughly blended with a Hobard HMC-450 cutter/mixer available from Hobart Corporation of Troy, Ohio. The paste is formed into a sheet and dried to a moisture content of about 8 percent. The thickness of the dried sheet, which is black in color, is about 0.4 mm. The moisture content of the dried sheet is readjusted to about 16 percent and the sheet is then shredded to give a cut filler suitable for use in manufacturing cigarettes. The cut filler (200 g.) is tumbled in an inclined rotating drum and sprayed with an aqueous solution comprising 50 grams of invert sugar (75% solids), 20 grams of water, 2 grams of propylene glycol and 15 grams of glycerol. With continued tumbling of the moistened and adhesive-coated cut filler, 50 grams of finely divided vermiculite prepared by the procedure of Example 1 is sprinkled onto the tumbling cut filler. The vermiculite is uniformly distributed on and adheres well to the surface oof the cut filler to impart an excellent tobacco-like brown color to the inherently black cut filler. The cut filler coated with the finely divided vermiculite is blended with conventionally processed and cut tobacco in proportions of 10:90, 30:70 and 50:50, respectively. The resulting blends of cut filler are made into cigarettes which produce smoke with reduced levels of nicotine therein when compared with cigarettes containing tobacco only. The cigarettes containing 10 to 30 percent by weight of the vermiculite-coated smoking composition exhibit very satisfactory smoking characteristics while the cigarette containing 50 percent by weight of the vermiculite-coated smoking composition is somewhat deficient in tobacco flavor but otherwise acceptable upon smoking.

What is claimed is:

1. A smoking product comprising a combustible smoking material coated with a quantity of finely divided vermiculite having a tobacco-like brown color, said finely divided vermiculite having been previously subjected to heat treatment at temperatures of at least 500° C. for a period of time sufficient to develop a brown color in said vermiculite and said quantity of finely divided vermiculite being sufficient to impart a tobacco-like brown color to said smoking material.

2. The smoking product of claim 1 wherein said finely divided vermiculite comprises particles having a maximum diameter of approximately 50 microns or less and said quantity is from 15 to 50 percent by weight based on the dry weight of the combustible smoking material.

3. The smoking product of claim 2 wherein said combustible smoking material is derived from thermally degraded tobacco materials.

4. The smoking product of claim 2 wherein said combustible smoking material is derived from non-tobacco materials.

5. The smoking product of claim 2 wherein said finely divided vermiculite comprises particles having a maximum diameter of 30 microns or less and said quantity of vermiculite applied to the smoking material is between 20 and 30 percent by weight.

6. The smoking product of claim 1, 2, 3, 4 or 5 wherein said combustible smoking material is cut, shredded or otherwise comminuted.

7. The smoking product of claim 6 which is combined and blended with conventionally processed tobacco in proportions up to 50 percent by weight and said smoking product is in the form of a cigarette.

8. A process for imparting a tobacco-like brown color to a combustible smoking material which comprises treating the combustible smoking material with an aqueous medium containing a humectant agent to moisten the surface of said combustible smoking material and applying to the moistened surface of the smoking material a quantity of finely divided vermiculate that has been previously subjected to heat treatment at temperatures of at least 500° C. for a period of time sufficient to develop a brown color in said vermiculite.

9. The process of claim 8 wherein said finely divided vermiculite comprises particles having a maximum diameter of approximately 50 microns or less and said quantity is from 15 to 50 percent by weight based on the dry weight of the combustible smoking material.

10. The process of claim 8 wherein said combustible smoking material is derived from thermally degraded tobacco materials.

11. The process of claim 8 wherein said combustible smoking material is derived from nontobacco materials.

12. The process of claim 8, 9, 10 or 11 wherein said combustible smoking material is cut, shredded or otherwise comminuted prior to treatment with said aqueous medium.

13. A process for preparing a smoking product which comprises (a) cutting, shredding or otherwise comminuting a combustible smoking material having a color other than that of cured tobacco leaves, (b) treating the cut, shredded or otherwise comminuted combustible smoking material with an aqueous medium that contains an adhesive agent and a humectant agent to moisten the surface of said material and (c) applying to the moistened surface of the cut, shredded or otherwise comminuted combustible smoking material sufficient finely divided vermiculate having a maximum diameter of approximately 50 microns or less to impart a tobacco-like brown color to said material, said vermiculite having been previously subjected to heat treatment at temperatures of 500° to 700° C. for a period of time sufficient to develop a brown color in said vermiculite.

14. The process of claim 13 wherein said finely divided vermiculite comprises particles having a maximum diameter of approximately 30 microns or less and the quantity of vermiculite applied to the surface of the combustible smoking material is at least 15 percent by weight based on the weight of the combustible smoking material.

15. The process of claim 13 or 14 wherein said combustible smoking material comprises thermally degraded tobacco materials and a water-soluble gum.

16. The process of claim 13 or 14 wherein said combustible smoking material comprises a non-tobacco smoking composition.

17. A process for treating expanded vermiculite to develop a brown color therein which comprises heating expanded vermiculite at temperatures in excess of 500° C. for a period of time sufficient to develop a brown color in said vermiculite.

18. The process of claim 17 wherein the expanded vermiculite is heated at temperatures of 500° to 700° C.

19. The process of claim 18 wherein the expanded vermiculite is heated at temperatures of 600° to 700° C. for 1 to 2 hours.

* * * * *